US006622320B2

(12) United States Patent
Ward

(10) Patent No.: US 6,622,320 B2
(45) Date of Patent: Sep. 23, 2003

(54) TOILET SEAT LIFT

(75) Inventor: Frederick A. Ward, Cairo, MO (US)

(73) Assignee: Showme Therapeutic Technologies, Inc., Cairo, MO (US)

( * ) Notice: Subject to any disclaimer, the term of this patent is extended or adjusted under 35 U.S.C. 154(b) by 0 days.

(21) Appl. No.: 10/091,736

(22) Filed: Mar. 6, 2002

(65) Prior Publication Data

US 2002/0124308 A1 Sep. 12, 2002

Related U.S. Application Data

(60) Provisional application No. 60/273,702, filed on Mar. 6, 2001.

(51) Int. Cl.[7] ..... A47K 13/10
(52) U.S. Cl. ..... 4/667; 4/566.1; 297/DIG. 10
(58) Field of Search ..... 4/667, 254, 905, 4/566.1; 297/DIG. 10

(56) References Cited

U.S. PATENT DOCUMENTS

| | | | | |
|---|---|---|---|---|
| 3,458,872 A | * | 8/1969 | Hellstrom et al. | 297/DIG. 10 |
| 3,473,174 A | | 10/1969 | Cool | |
| 4,185,335 A | | 1/1980 | Alvis | |
| 4,581,778 A | | 4/1986 | Pontoppidan | |
| 4,587,678 A | * | 5/1986 | Love et al. | 4/667 |
| 4,777,671 A | * | 10/1988 | Kearns | 4/566.1 |
| 4,833,736 A | | 5/1989 | Sadler et al. | |
| 4,884,841 A | | 12/1989 | Holley | |
| 4,938,533 A | | 7/1990 | Thielois | |
| 4,993,085 A | | 2/1991 | Gibbons | |
| 5,142,709 A | | 9/1992 | McGuire | |
| 5,155,873 A | | 10/1992 | Bridges | |
| 5,189,739 A | | 3/1993 | Thierry | |
| 5,309,583 A | | 5/1994 | White et al. | |
| 5,323,497 A | | 6/1994 | Lih et al. | |
| 5,346,280 A | | 9/1994 | Deumite | |
| 5,440,767 A | | 8/1995 | Bergenwall | |
| 5,561,872 A | | 10/1996 | Phillips | |
| 5,661,858 A | | 9/1997 | House et al. | |
| 5,704,075 A | * | 1/1998 | Machanic | 4/905 |
| 5,737,780 A | | 4/1998 | Okita et al. | |
| 5,819,325 A | | 10/1998 | Richards | |
| 5,848,447 A | | 12/1998 | Lindsay | |
| 5,896,598 A | * | 4/1999 | Jeans | 4/566.1 |
| 6,035,462 A | * | 3/2000 | Bennett et al. | 4/667 |
| 6,098,215 A | | 8/2000 | Goodwin | |
| 6,154,896 A | | 12/2000 | Houston et al. | |
| 6,161,229 A | | 12/2000 | Ryan et al. | |
| 6,189,164 B1 | * | 2/2001 | Krapu | 4/667 |
| 6,360,382 B1 | * | 3/2002 | Karash | 4/667 |

* cited by examiner

*Primary Examiner*—Gregory L. Huson
*Assistant Examiner*—Amanda Flynn
(74) *Attorney, Agent, or Firm*—Senniger, Powers, Leavitt & Roedel

(57) ABSTRACT

A toilet seat lift comprising a base having opposite sides, a seat support mounted on the base for pivotal movement about a generally horizontal axis extending side-to-side with respect to the base between a lowered position and a raised position, a seat on the seat support having an opening therein adapted to overlie a toilet, and a power actuator for pivoting the seat support from its lowered position to its raised position.

10 Claims, 15 Drawing Sheets

TOILET SEAT LIFT

BACKGROUND OF THE INVENTION

This invention relates generally to physical therapy and health equipment, and more particularly to a toilet seat lift for facilitating a person's use of the toilet.

SUMMARY OF THE INVENTION

Among the several objects of this invention may be noted the provision of an improved toilet lift seat for facilitating the use of a toilet by a person who is infirm or disabled; the provision of such a lift seat which is economical to manufacture; the provision of such a lift seat which is sturdy and durable; the provision of such a toilet seat which is easy to use; the provision of such a lift seat which can be powered either by electric current or by household water pressure; and the provision of such a lift seat which can readily be moved from one location to another.

In general, a toilet lift seat of this invention comprises a base having opposite sides, a seat support mounted on the base for pivotal movement about a generally horizontal axis extending side-to-side with respect to the base between a lowered position and a raised position, a seat on the seat support having an opening therein adapted to overlie a toilet, and a power actuator for pivoting the seat support and seat thereon from said lowered position to said raised position.

The power actuator can be an inflatable bladder, or a pneumatic or electric power cylinder, or other suitable mechanical assist for pivoting the seat support and seat.

Other objects and features will be in part apparent and in part pointed out hereinafter.

BRIEF DESCRIPTION OF THE DRAWINGS

Corresponding parts are designated by corresponding numbers throughout the drawings.

DETAILED DESCRIPTION OF PREFERRED EMBODIMENTS

Figure 1:
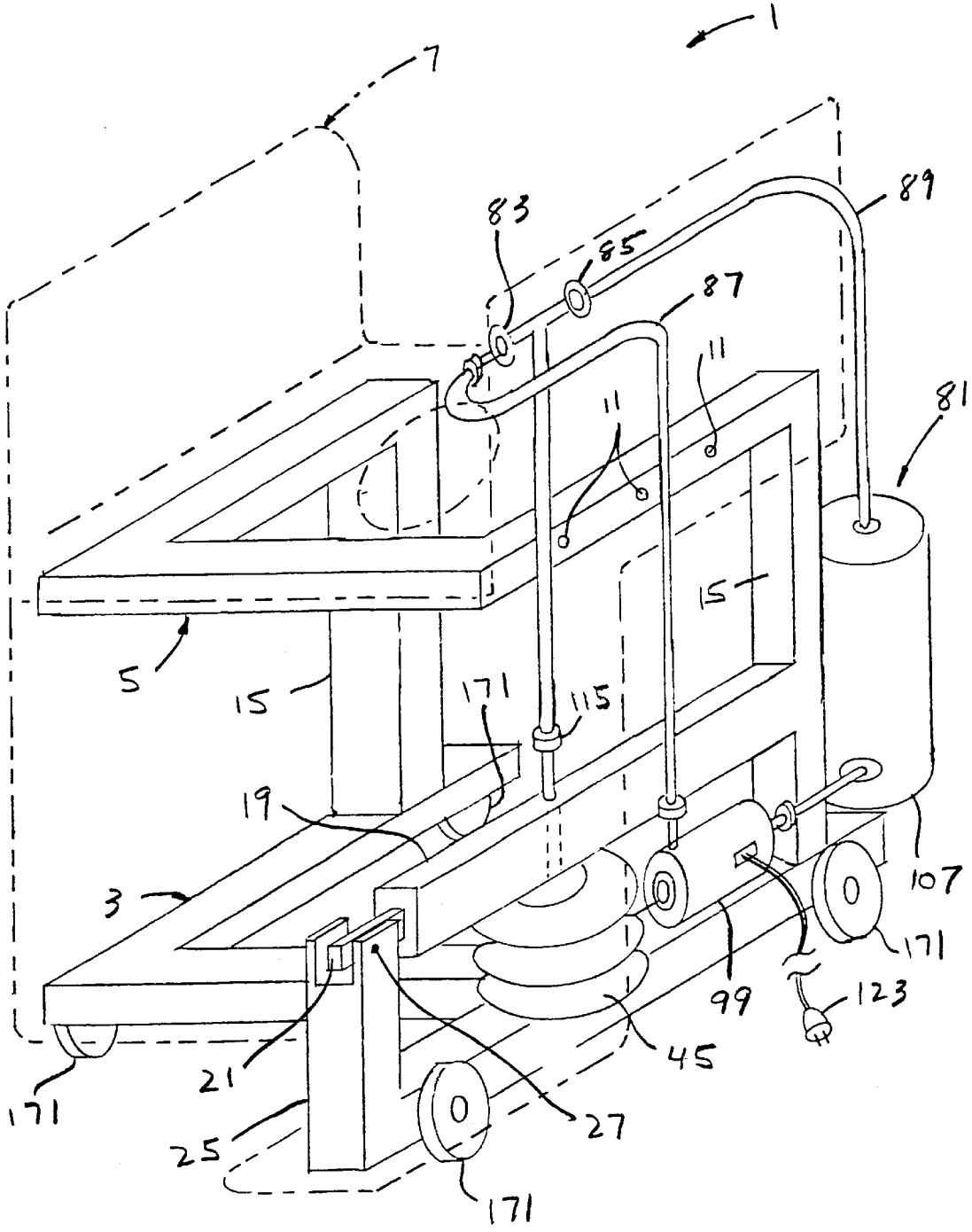
FIG. 1 is a perspective view of an hydraulic toilet seat assembly embodying the present invention demonstrating portability.

Referring to the drawings, FIG. 1 illustrates one embodiment of a toilet lift seat of the present invention, the device being designated in its entirety by the reference numeral 1. The lift seat comprises a base generally designated 3 and a seat support generally designated 5 which serves the primary purpose of supporting a seat 7 (in phantom). The seat 7 is attached to the seat support 5 by fasteners 11. The base 3 comprises a plurality of metal tubular bars, for example, welded generally in the shape of an "h", to be placed in a position surrounding a standard toilet and supported by a floor or other surface. The seat support 5 is similarly constructed of tubular bars welded in a horseshoe like shape and configured to have two contacting posts, each designated 15, which are supported by base 3 adjacent the rear of the base. A pivot bar 19 extends forward from one of the posts 15 and has an extension 21 at its front end which is pivotally connected to a pivot post 25 on the base by means of a pivot connection comprising pin 27 for pivotal movement of the seat support 5 relative to the base 3 about the generally horizontal axis of the pin 27 from the lowered portion shown in FIG. 1 to the raised position shown in FIG. 8.

Figure 11:
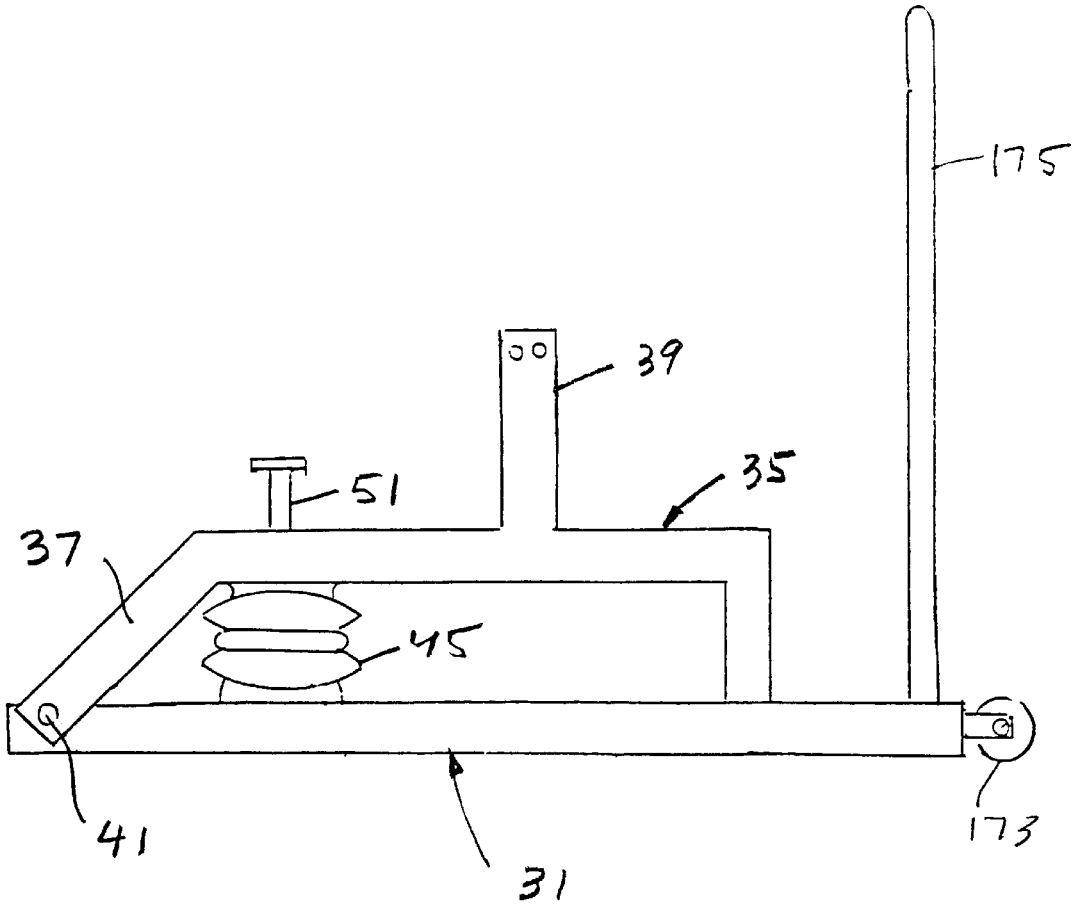
FIG. 11 is a side view of the framework demonstrating a handle and a wheel suitable for tilting.
Figure 12:
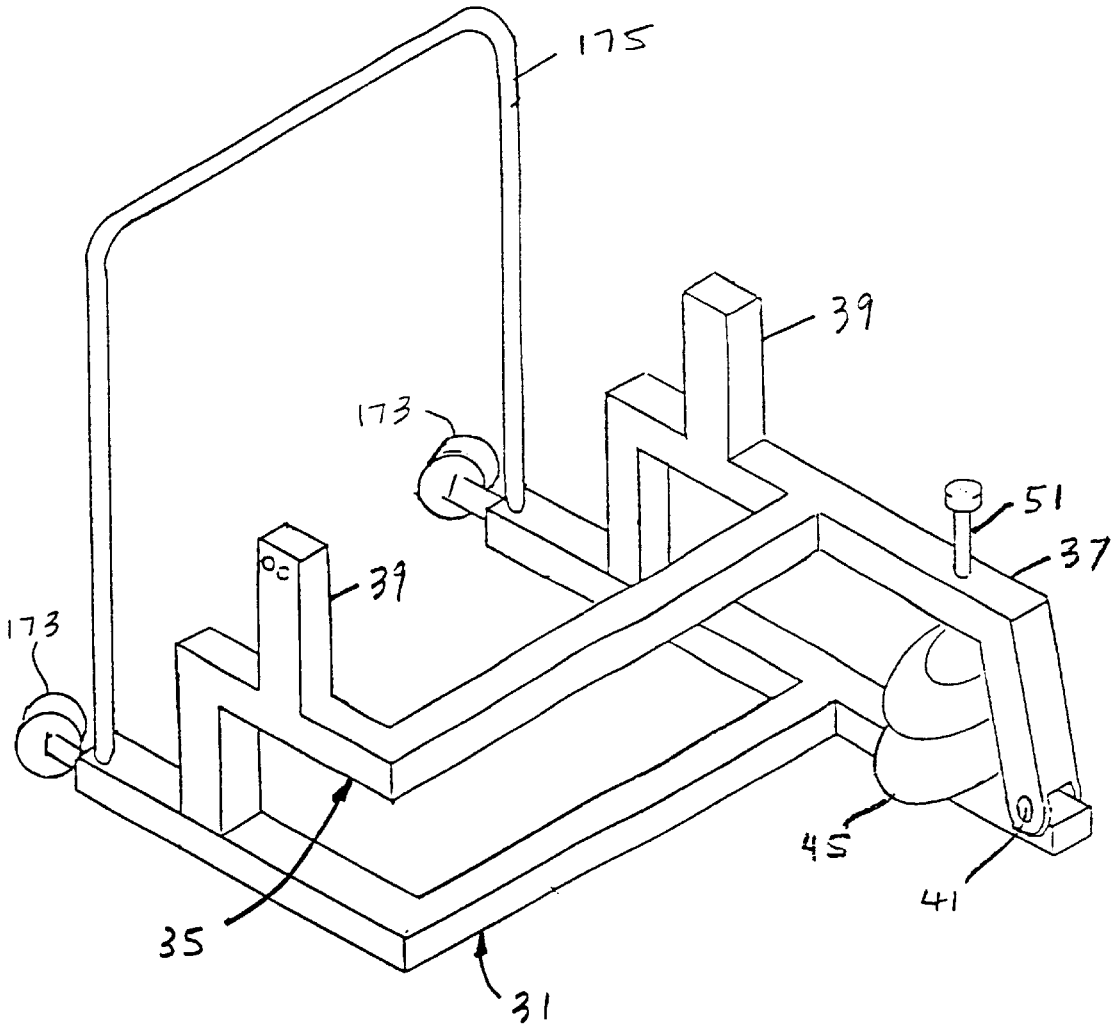
FIG. 12 is a perspective view of the invention depicting a variation of the seat support framework.

FIGS. 11 and 12 show a different version of a base 31 and seat support 35. In this embodiment, the base 31 is generally "h" shaped and flat, and the seat support 35 comprises a pivot bar 37 and a pair of posts 39 extending up from the pivot bar for attachment of a seat (not shown) thereto. The pivot bar 37 angles down to a pivot pin connection 41 with the front of the base 31. Thus, in this embodiment, the fulcrum point of the seat support 35 is positioned in the horizontal plane of the base 31 as opposed to the position noted in FIG. 1 where the fulcrum is elevated with respect to the plane of the base 3.

Figure 7:
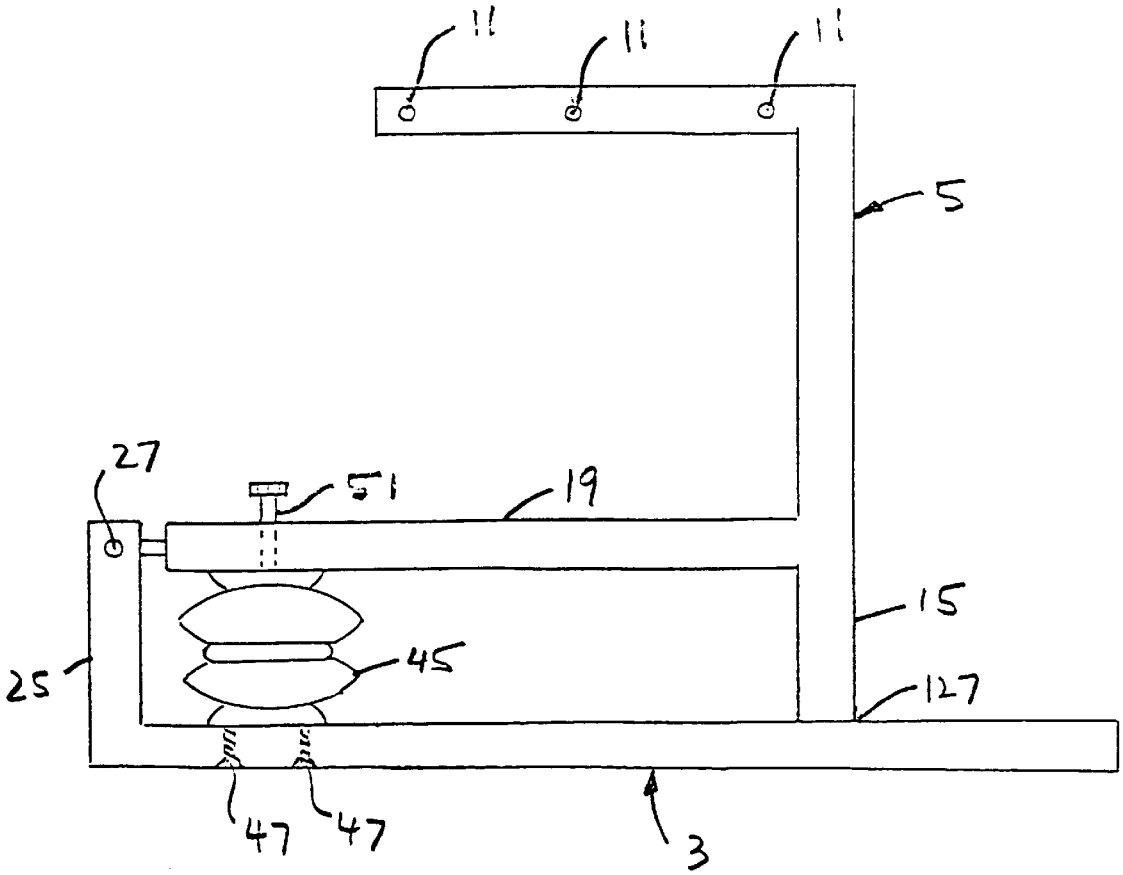
FIG. 7 is a view of the invention as seen from the left side of the seated user.

In one embodiment (FIGS. 1–8), a power actuator comprising a bladder 45 is secured to the base 3 by fasteners 47 (FIG. 7) extending through the base at a location generally adjacent the pivot post 25. The bladder 45 is secured to the seat support 5 by a nozzle 51 extending up through a hole in the pivot bar 19. The bladder is preferably positioned close to the pivot connection 27 and provides lift for the seat support 5 and the seat 7 when the bladder 1 is inflated by pneumatic pressure as demonstrated in FIG. 4, or by hydraulic pressure as generally demonstrated in FIG. 5. When the bladder 1 is inflated, it lifts the seat support and seat through an arc generally designated by the numeral 55 in FIG. 8, centered on the generally horizontal axis of the pin 27.

Figure 10:
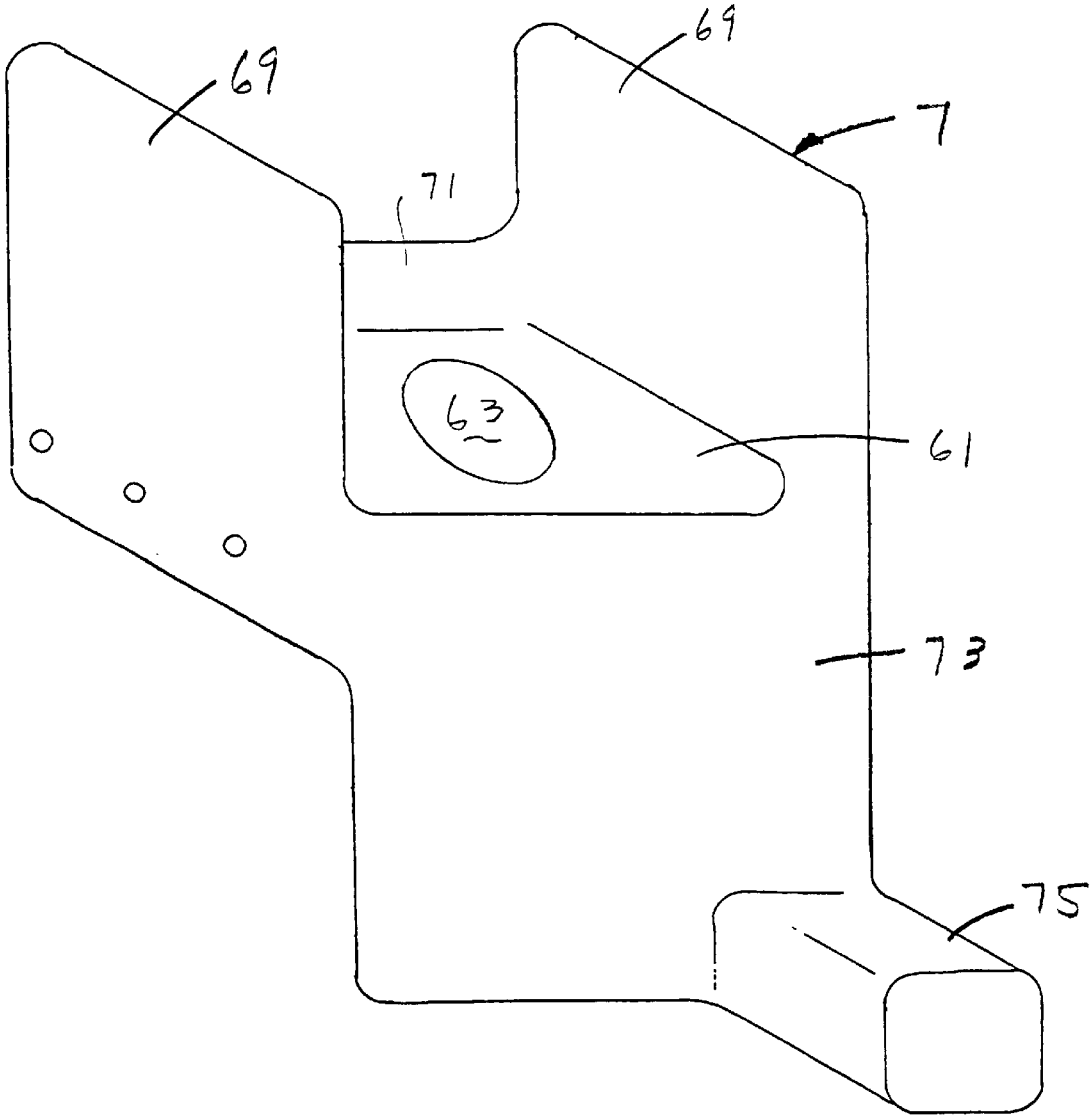
FIG. 10 is a perspective view of a seat unit for covering the framework.

The seat 7, shown in FIG. 10, consists of a rectangular platform 61 having a centrally located opening 63 therein, and side walls 69 extending upwardly from the platform at opposite sides of the platform to form hand holds and/or arms. The side walls 69 are solidly constructed and designed to prevent the user from placing the user's appendages, such as fingers, hands, or arms, in areas where there might be a risk of being trapped or injured during the operation of the device. The seat 7 has a relatively short back 71 which extends up from the seat platform 61 to provide substantial rigidity to the seat. A front section 73 extends down from platform 61 at the front of the seat to a position approximately one to two inches from the floor to prevent the user from placing appendages, such as toes, feet or ankles in areas where they might be trapped or injured during the operation of the device. A further extended structure 75 extends forward from the front section 73 and covers the bladder 45, the forward parts of the base 3 and seat support 5, the pivot post 25 and pin connection 27, to prevent the user from trapping or injuring appendages, such as toes, feet, ankles, fingers, hands or arms in the operating mechanism of the device.

Figure 4:
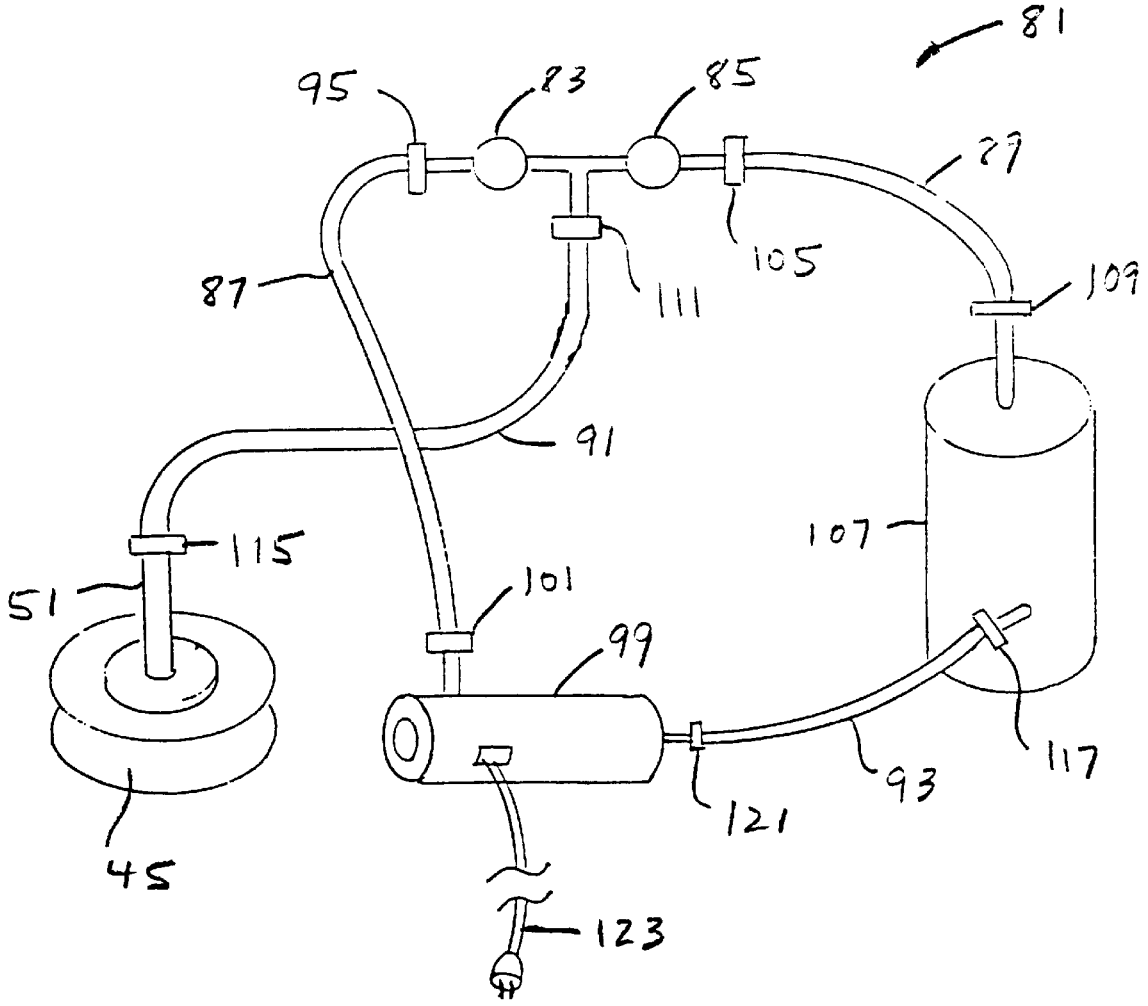
FIG. 4 is a schematic representation of a closed hydraulic or pneumatic system suitable for portability.

With particular reference now to FIGS. 1 and 4, a pneumatic control system suitable for the toilet lift seat 1 is schematically illustrated at 81. The system 81 includes a control assembly comprising a normally closed inlet valve 83 having an actuator such as a depressable control button (not shown), a normally closed outlet valve 85 having an actuator such as a depressable control button (not shown), and four flow lines 87, 89, 91, 93. The first line 87 is attached at one end to inlet valve 83 by a connector 95 and at its other end to a pneumatic pump 99 by a connector 101. The second line 89 is attached at one end to valve 85 by a connector 105 and at its other end to a storage tank 107 by a connector 109. The third line 91 is attached at one end to valve 83 and valve 85 by a T-connector 111 and at its other end to the nozzle 51 of the bladder 45 by a connector 115. The fourth line 93 is connected at one end to tank 107 by a connector 117 and is connected at its other end to pump 99 by a connector 121. The pump 99 is preferably an electric pump having an electric chord 123 and suitable switching for operating the pump.

Figure 2:
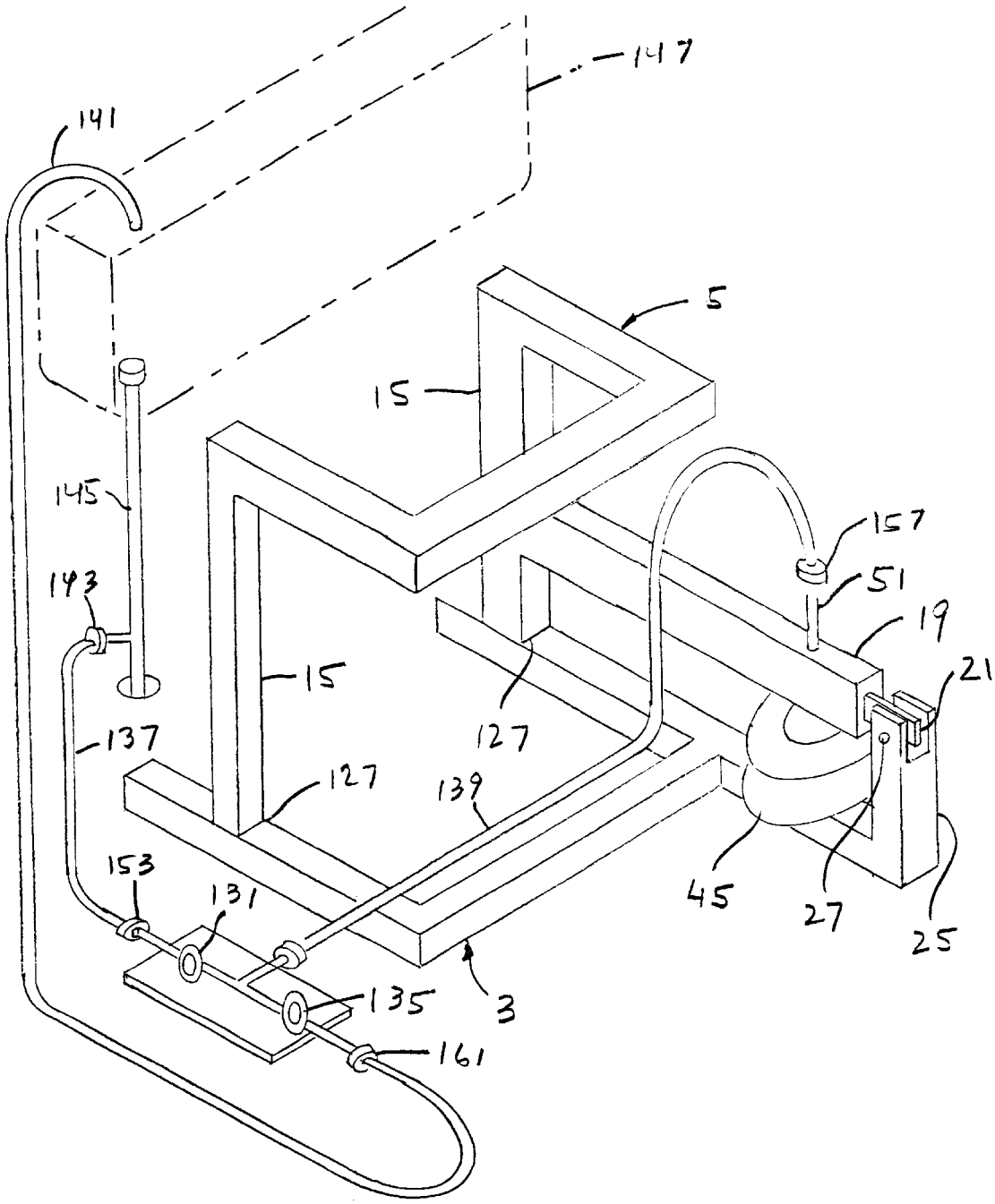
FIG. 2 is a schematic representation of the welded framework representing a permanently installed unit designed to surround a permanently fixed standard toilet.

When inlet valve 85 is opened and outlet valve 83 is closed, pump 99 is operated to pump air or other suitable gas from storage tank 107 through line 89, open valve 85 and line 91 into the bladder 45, which expands the bladder to cause downward pressure on base 3 and upward pressure on seat support 5. The expanding bladder causes the seat support 5 and seat 7 to rise through an arc as demonstrated in FIG. 8, lifting the user from a seated position to a standing position. When the inlet valve 85 is closed and the outlet valve 83 is opened, air is expelled from bladder 45 by the force caused by the combined weights of the seat support 5, the seat 7 and the user, thus leaving a user to move from a standing position to a seated position, whereupon the contact posts 15 of the seat support 5 make contact with the base 3 at locations 127 (FIG. 2). In this position, the user is supported for use of the toilet in a normal fashion through the opening 63 in seat 7. The fluid or air is exhausted from the bladder 45 through lines 91 and 89 to storage tank 9, to be stored until the user opens valve 85 again.

Figure 5:
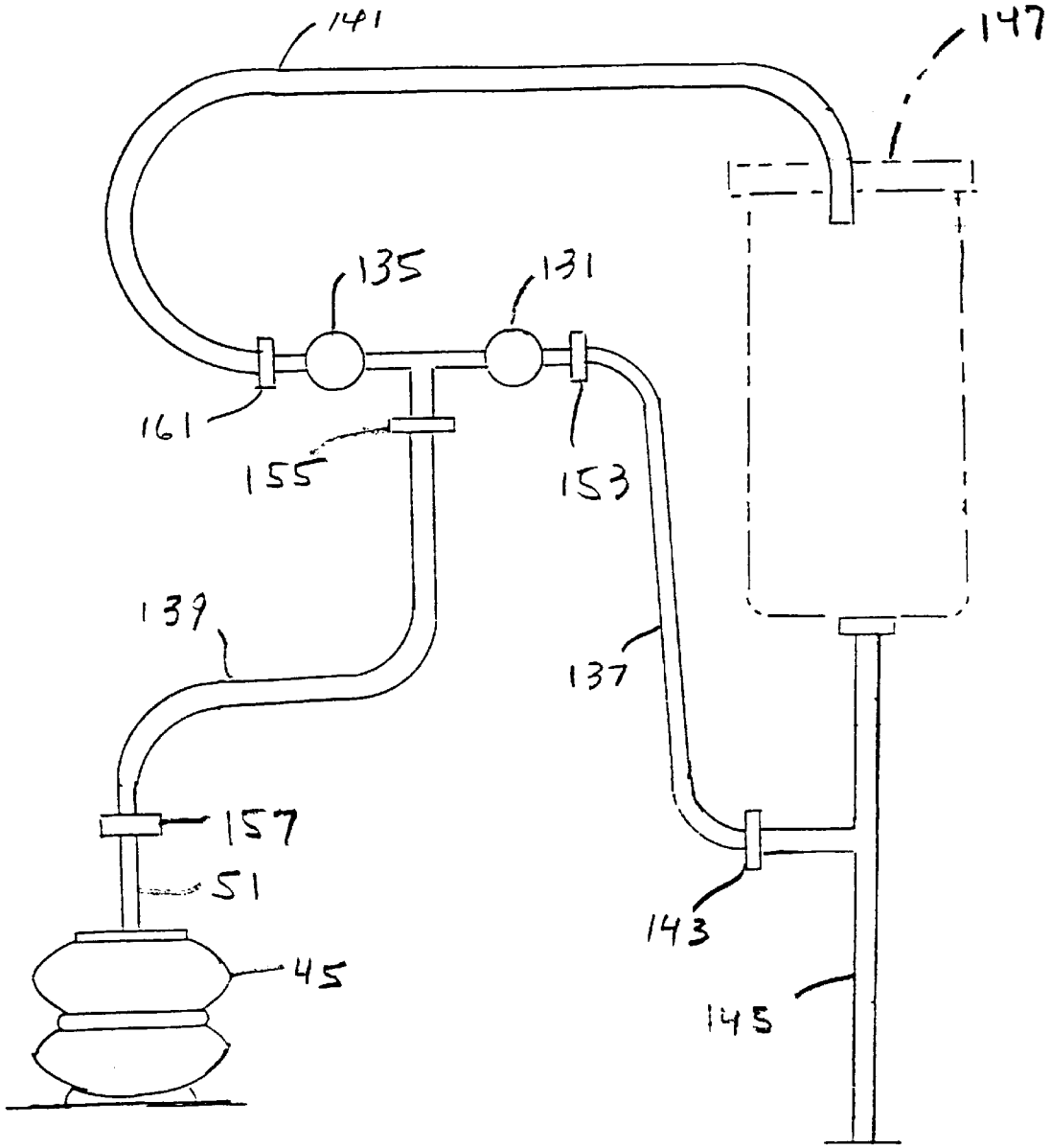
FIG. 5 is a schematic representation of a hydraulic system suitable for connecting into a common household water supply.
Figure 6:
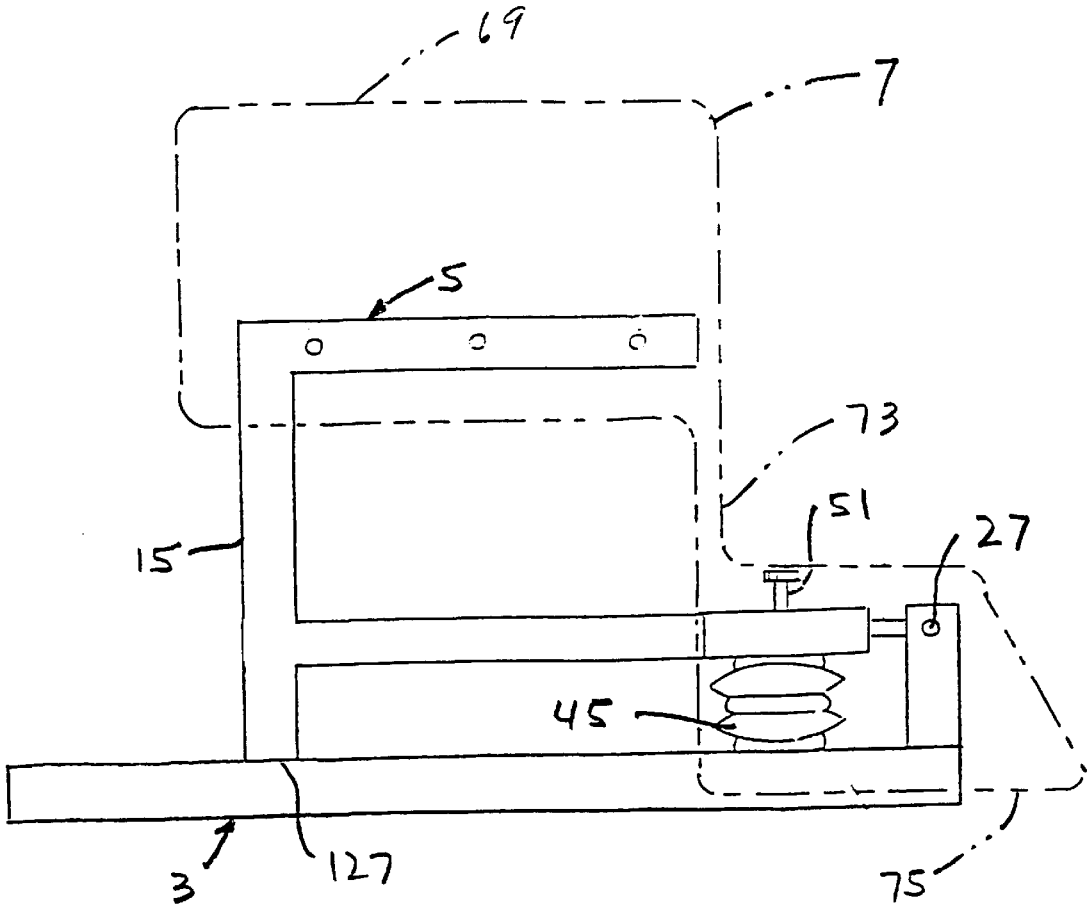
FIG. 6 is a view of the invention as seen from the right side of the seated user.

FIGS. 2 and 5 illustrates an exemplary hydraulic control system suitable for use with the toilet lift seat 1. The system includes a control assembly comprising a normally closed inlet valve 131 and associated actuator (not shown), a normally closed outlet valve 135 and associated actuator (not shown), and three lines 137, 139, 141 connected in the manner illustrated. The first line 137 is attached by means of a connector 143 to a service line 145, which is the water supply line for a storage tank 147 and which preferably originates from a common water supply for a residence or institution. The water in this supply is typically at a pressure in the range of 35–55 psi. The other end of line 137 is fastened by a connector 153 to the inlet valve 131. The second line 139 is attached at one end to valves 131 and 135 by means of a T-connector 155 and at its other end to the nozzle 51 of the bladder 45 by means of a connector 157. The third line 141 is connected at one end to outlet valve 135 by a connector 161 and is open at its other end for evacuation into tank 147. In this embodiment, no pump is required to pressure the fluid, since the water supplied to the bladder is already under pressure as provided by the water supply line 145.

Figure 8:
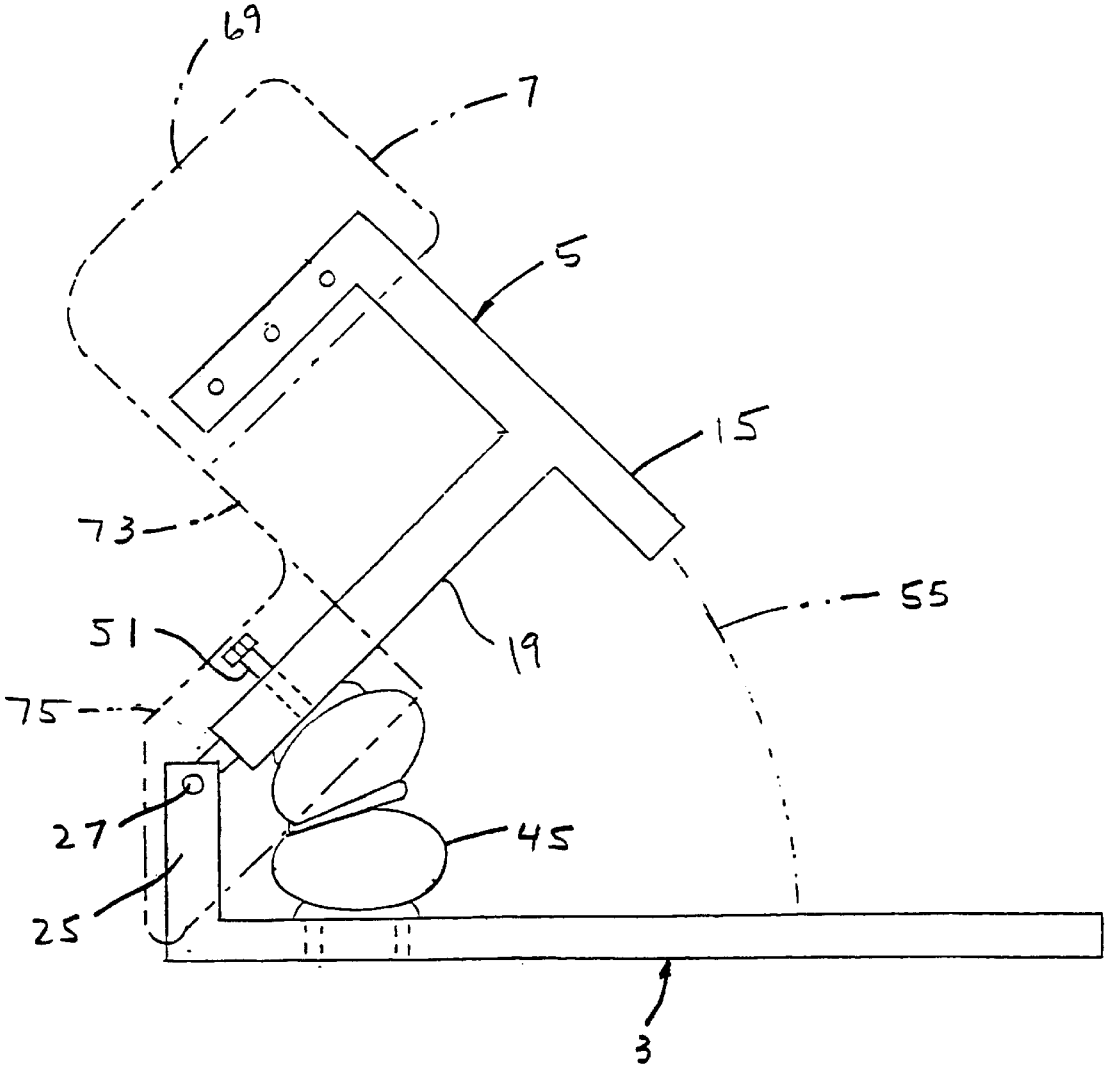
FIG. 8 is a view of the invention from the seated user's left side depicting the fully elevated position.

When inlet valve 131 is opened and outlet valve 135 is closed, water is allowed to flow under pressure from the common water supply through lines 145, 137 and 139 into the bladder 45, causing the bladder to expand to lift the seat support 5 and seat 7 in an arc, as demonstrated in FIG. 8, and causing the user to rise from a seated position to a standing position. When outlet valve 135 is opened and inlet valve 131 closed, water in the bladder 45 is released through line 139 into line 141 and evacuated into tank 147 which causes seat support 5 and seat 7 to descend to their original home position, making contact with the base 3 at locations 127 and permitting the user to move from a standing position to a seated position for use of the toilet as previously described.

With particular reference now to FIGS. 1, 2 and 5, the location of the controls (e.g., manual actuators) for actuating the inlet valve 83 (131), outlet valve 85 (135) and pump 99 (if required) can vary. For example, the actuators can be attached to the left or right side wall 69 of the seat 7, as shown in FIG. 1, or to the floor as shown in FIG. 2, or to a wall as shown in FIG. 5. With the ability to place the controls on the floor or attached to a wall, one person may operate the controls while another person assists the user in rising or sitting on the device.

In particular, placement of the controls on the floor allows a nursing assistant to operate the lift seat with a foot in a safe manner while assisting a patient on and off the seat with the advantage of having both hands free to insure the safe assistance of the patient. Mounting the controls on a wall, on the other hand, allows an operator to control the operation of the device in a situation where the user may not be mentally capable of understanding the task being performed. For example, if a mentally incapable user were to actuate valves 83 (131) or 85 (135) at an inappropriate time, the user could be at risk of slipping off the device or standing mechanically when an assistant was not prepared for the user to stand, causing an inherent risk of falling. With the valves 83 (131) and 85 (135) and associated controls mounted on the right wall or left side wall 69 of seat 7, as demonstrated in FIG. 1, the user may operate the lift seat without assistance when they are mentally capable of such control, even though suffering a disability which requires the use of a lift seat.

With particular reference now to FIG. 1, the toilet lift seat 1 including pump 99, tank 107, valves 83 and 85 and bladder 45, is rendered mobile by the addition of wheels 171 at the front, back and opposite sides of the base 3. With the addition of wheels 171, the unit may be rolled in a flat, four wheeled configuration. Alternatively, the system can be equipped with wheels 173 as shown in FIGS. 11 and 12. With the addition of wheels 173, the unit may be tipped backward through the use of a handle 175 and rolled from user to user or from one bedside to another bedside with the only external support being the necessity to secure electric current from any common source for pump 99 (if required) by means of the electric chord 123.

Figure 3:
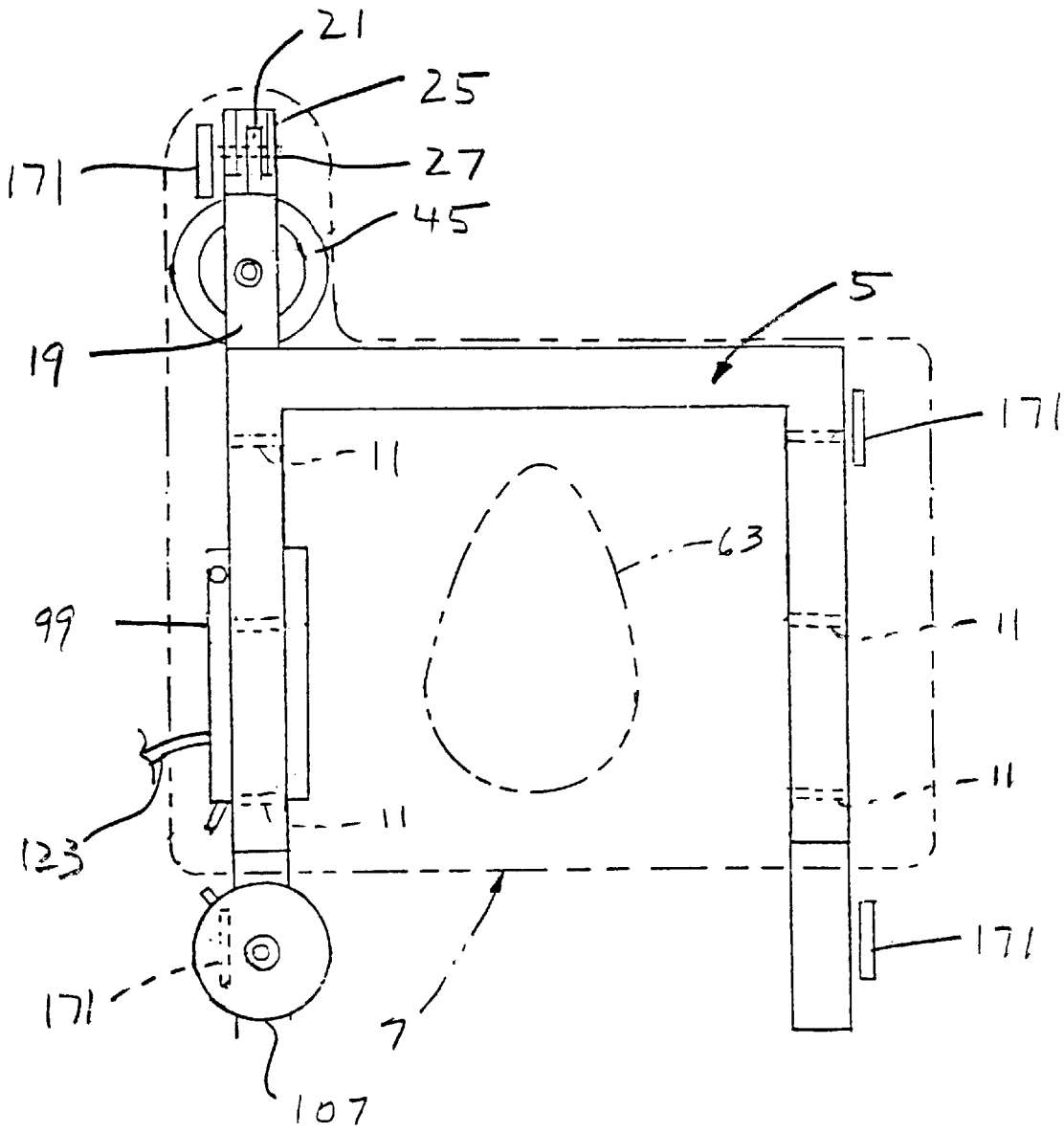
FIG. 3 is a top plan view of the invention depicting various components of the portable assembly.

FIG. 3 is a top plan view showing the positions of pump 99, bladder 45 storage tank 107, wheels 171 and seat 7. Also shown are the positions of fasteners 11 used to attach the seat 7 to the seat support 5.

Figure 9:
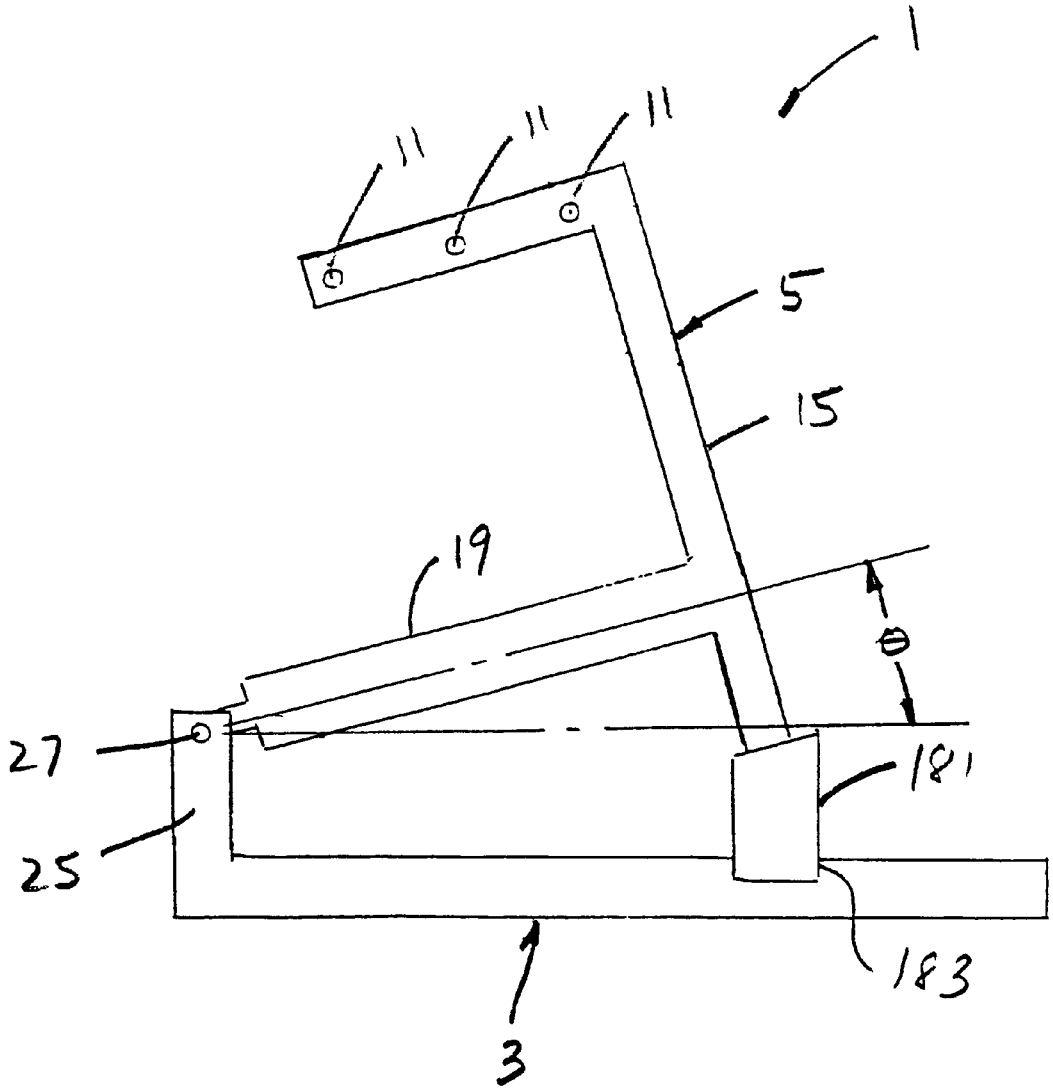
FIG. 9 is a side view of the invention showing the use of a block to support the seat in an inclined position.

FIG. 9 shows an optional feature of the toilet lift seat 1. In this embodiment, the seat 7 may be positioned with the platform 61 of the seat (i.e., the portion with the opening 63 therein) at a forward slanted angle at any degree prescribed by a physician who may desire a user (patient) to sit in a position other than in a flat, horizontal position. To so position the seat 7, one or more blocks 181 or other suitable stops are placed between base 3 and the seat support 5, at a location 183 for contact by posts 15. In the particular embodiment shown in FIG. 9, the seat support 5 is supported at an angle θ of about fifteen degrees from the horizontal plane. Stop(s) 181 may be of any desired height to accommodate virtually any degree of inclination of the seat support 5 and seat 7 (e.g. 5°–45°)

Figure 13:
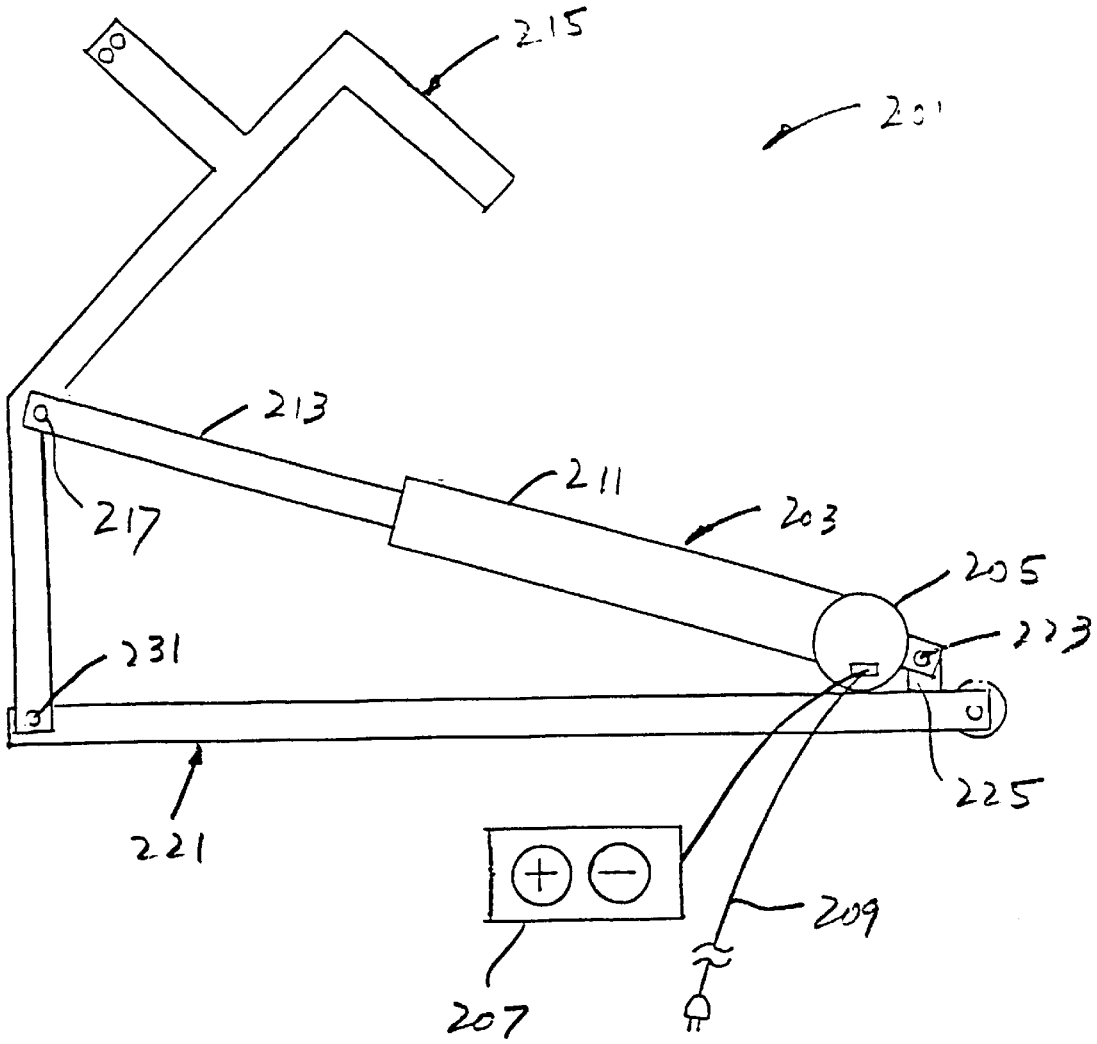
FIG. 13 is a side elevation of a seat support of another embodiment in which the seat support is moved to its raised position by an electrically powered actuator.
Figure 14:
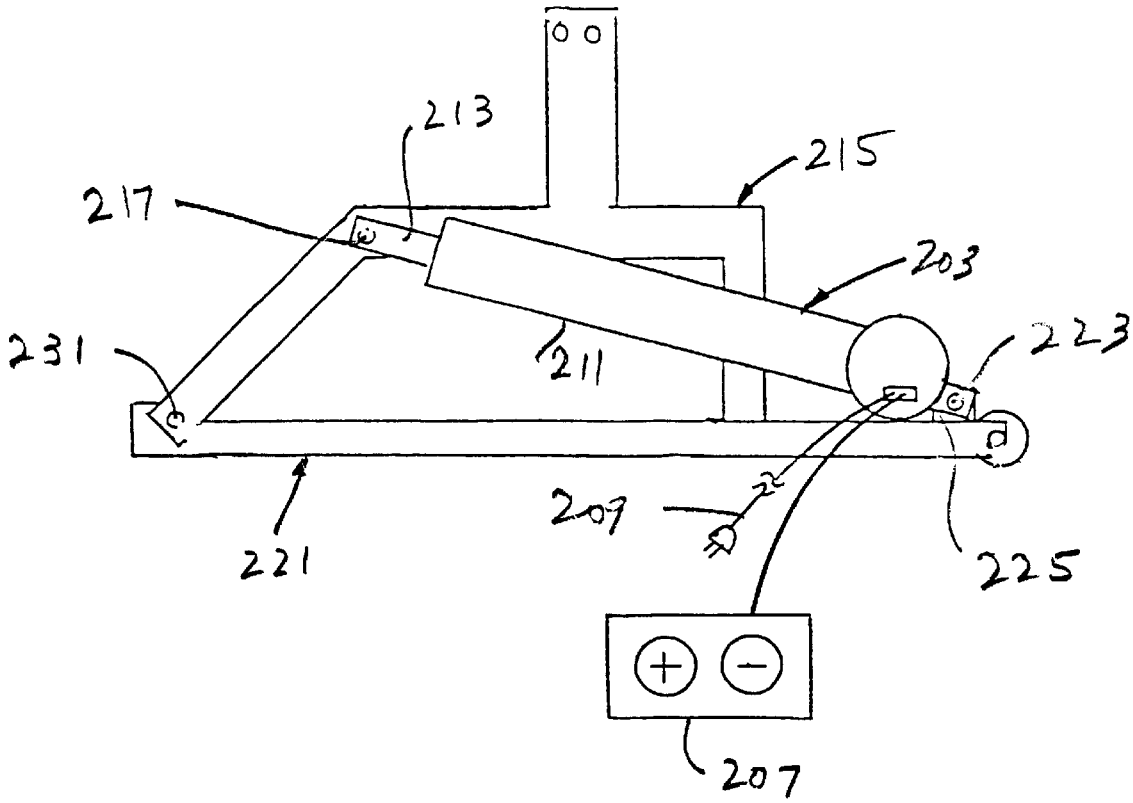
FIG. 14 is a side elevation similar to FIG. 13 but showing the seat support in a lowered position.
Figure 15:
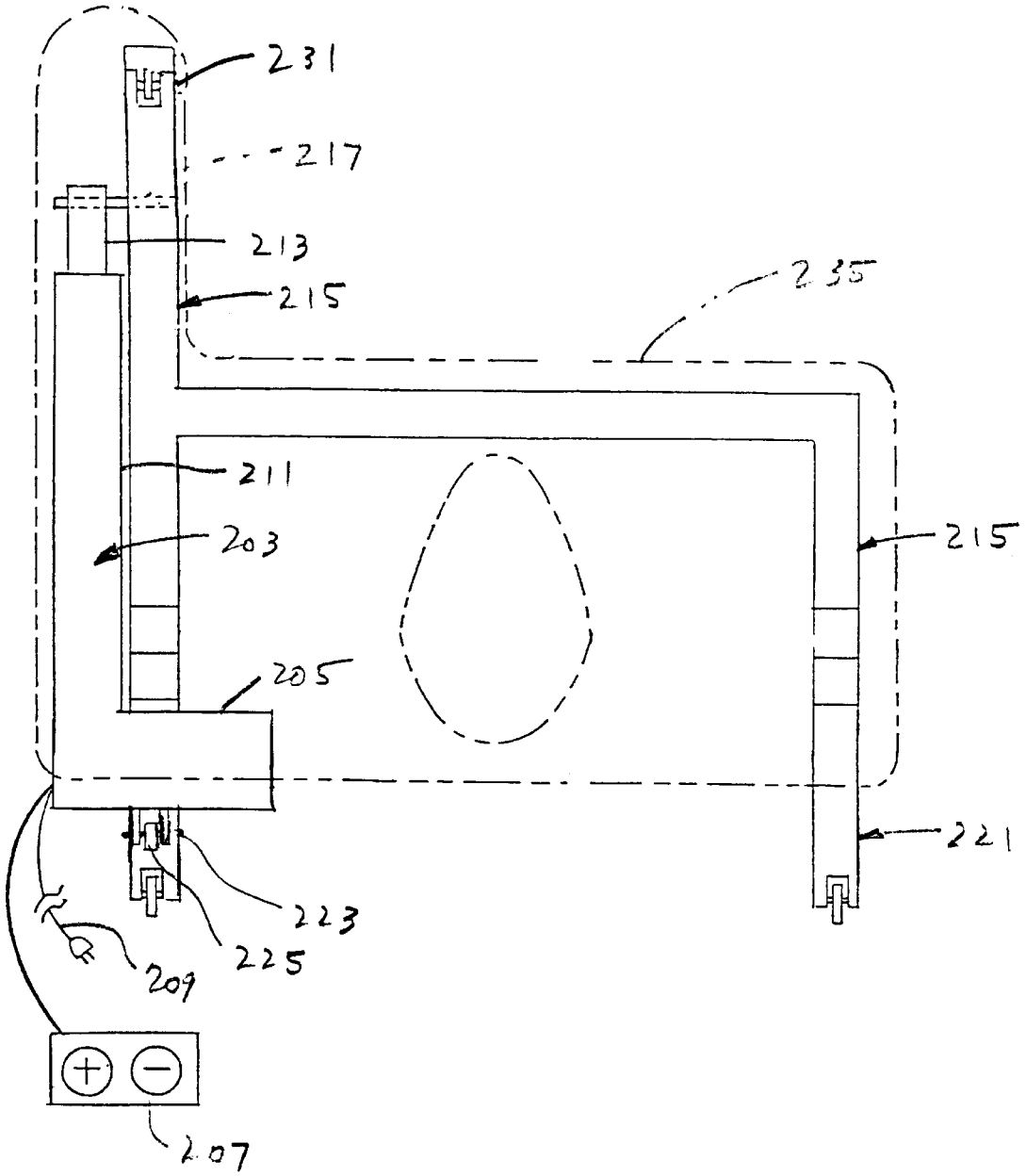
FIG. 15 is a top plan view of the seat support and actuator of FIG. 14, the seat being shown in phantom.

FIGS. 13, 14 and 15 illustrate a variation of a toilet lift seat of the present invention generally designated 201, in which the inflatable bladder 45 is replaced by a different type of power actuator, generally designated 203. In this embodiment, the actuator 203 comprises an electric motor 205 with appropriate control switches 207 and an electric chord 209. The motor 205 powers the extension and retraction of a power cylinder 211 having a moveable rod 213. The rod 213 is pivotally attached at its forward end to the seat support 215 by a suitable pin connection 217, and the cylinder 211 is pivotally attached at its rearward end to the base 221 by suitable means, such as a pin connection 223 between the actuator and a bracket 225 attached to the base. The pivot connections 217, 223 are significant in establishing a fulcrum. The power actuator 203 disclosed in the drawings is commercially available under the trade designation *Electromotoren* from Litton Precision Products International, Inc., Gubelstr. 28, 8050 Zurich, Switzerland. In the embodiment shown in FIGS. 13–15, the seat support 215 is pivoted at 231 to the base 221, as previously described with respect to FIG. 11.

When electric current is applied to the power actuator 203, and the appropriate control switch 207 is operated, the rod 213 extends from the cylinder 211, causing forward pressure on seat support 215 at the point of attachment 217 and rearward pressure on the base 221 at point of attachment 223. As a result, the seat support 215 and seat 235 (FIG. 15) pivot about pivot connection 231 with the base 221 through an arc from the lowered position shown in FIG. 14 to the raised position shown in FIG. 13, lifting a person on the seat to an essentially standing position.

When the electric current is reversed by engaging a second control switch 207, the cylinder rod 211 retracts to lower the seat support 215 and seat 235 from the FIG. 13 raised position to the lowered position depicted in FIG. 14.

It will be understood that the embodiments described above are merely exemplary and are not intended to be limiting in any way. In general, the present invention is directed to a toilet seat lift comprising a base having opposite sides, a seat support mounted on the base for pivotal movement about a generally horizontal axis extending side-to-side with respect to the base between a lowered position and a raised position, a seat on the seat support having an opening therein adapted to overlie a toilet, and a power actuator for pivoting the seat support from the lowered position to the raised position.

In one embodiment, the power actuator is an inflatable bladder (e.g., 45) positioned between the base and the seat support, and an inflation system inflates the bladder to pivot the seat support from its lowered position to its raised position. The particular inflation system used is not critical. It may be pneumatic, hydraulic or any other type of inflation system. The bladder may be of fabricated from any suitable material which is both flexible and durable, e.g., rubber, and may be purchased from a suitable commercially available source, such as B.F. Goodrich Co. In another embodiment, the power actuator is a power cylinder (e.g., 203) which may be operated by electric motor. Alternatively, the power cylinder may be operated pneumatically or hydraulically.

The precise construction of the seat support and seat is not critical to this invention. The seat may be of one-piece plastic molded construction, or some other construction. The seat support (e.g., 5) is preferably a frame constructed of welded metal tubing, but other constructions are also contemplated. It will also be understood that the seat support and seat can be integrally formed as one piece. The pivot design may also vary from the embodiments shown in the drawings. When actuated, the power actuator should raise the seat support and seat thereon to a position in which the user can comfortably stand off the seat support. For example, in its raised position, the seat may be at an angle of about 70–85 degrees from horizontal.

It will be understood that a toilet lift seat of this invention can be used to allow a person to use a conventional restroom toilet by moving the lift seat to a position in which the opening 63 in the seat is directly above the toilet. Alternatively, a suitable receptacle may be attached to the seat or seat support below the opening 63. In this case, the receptacle may be removable to facilitate emptying and cleaning.

Regardless of what type of power actuator is used for raising and lowering the seat support and seat, it is preferable that it be operable to stop the seat at any position between its fully raised and fully lowered positions. This makes use of the lift seat more adaptable to the needs and/or desires of different users.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A toilet seat lift comprising a base having opposite sides, a seat support having a pivot connection with the base for pivotal movement of the seat support between a lowered position and a raised position about a generally horizontal axis extending through said connection and side-to-side with respect to the base, a seat on the seat support having a seat opening therein adapted to overlie a toilet, said seat support, seat and seat opening all pivoting about said pivot connection as the seat support pivots between said raised and lowered positions, and a power actuator for pivoting the seat support from said lowered position to said raised position, wherein said pivot connection between the seat support and the base is at only one side of the base and at a location forward of said seat opening.

2. A toilet seat lift comprising a base having opposite sides, a seat support having a pivot connection with the base for pivotal movement of the seat support between a lowered position and a raised position about a generally horizontal axis extending through said connection and side-to-side with respect to the base, a seat on the seat support having a seat opening therein adapted to overlie a toilet, said seat support, seat and seat opening all pivoting about said pivot connection as the seat support pivots between said raised and lowered positions, and a power actuator for pivoting the seat support from said lowered position to said raised position, wherein said seat support comprises a rigid frame including two upright posts for supporting said seat and a bar having a first end rigidly connected to one of said posts and a second end pivotally connected to said base.

3. A toilet seat lift as set forth in claim 2 wherein said power actuator is positioned between the base and said bar at a location forward of said seat opening when said seat support is in its lowered position.

4. A toilet seat lift comprising a base having opposite sides, a seat support having a pivot connection with the base for pivotal movement of the seat support between a lowered position and a raised position about a generally horizontal axis extending through said connection and side-to-side with respect to the base, a seat on the seat support having a seat opening therein adapted to overlie a toilet, said seat support, seat and seat opening all pivoting about said pivot connection as the seat support pivots between said raised and lowered positions, and a power actuator for pivoting the seat support from said lowered position to said raised position, wherein said seat comprises a platform having said seat opening therein, side walls, extending up from the platform at opposite sides thereof, a back extending up from the platform, and a front section extending down from the platform.

5. A toilet seat lift as set forth in claim 4 wherein said front section of the seat includes a forward-extending structure for covering parts of the seat support.

6. A toilet seat lift as set forth in claim 4 wherein said seat is of one-piece molded construction.

7. A toilet seat lift comprising a base having opposite sides, a seat support mounted on the base, a seat on the seat support having a seat opening therein adapted to overlie a toilet, said seat support being mounted on the base for pivotal movement of the seat support and said seat about a generally horizontal axis extending side-to-side with respect to the base between a lowered position and a raised position, and a power actuator for pivoting the seat support from said lowered position to said raised position, said seat support comprising a rigid frame pivotally connected to said base, and said seat comprising a platform having said toilet seat opening therein, side walls extending up from the platform at opposite sides thereof, a back extending up from the platform, and a front section extending down from the platform.

8. A toilet seat lift as set forth in claim 7 wherein said seat is of one-piece molded construction.

9. A toilet seat lift comprising a base having opposite sides, a seat support mounted on the base, a seat on the seat support having a seat opening therein adapted to overlie a toilet, said seat support being mounted on the base for pivotal movement of the seat support and said seat about a generally horizontal axis extending side-to-side with respect to the base between a lowered position and a raised position, and a power actuator for pivoting the seat support from said lowered position to said raised position, said seat support comprising a rigid frame having a pivot connection with the base at only one side of the base at a location forward of said seat opening.

10. A toilet seat lift as set forth in claim 9 wherein said seat comprises a platform having said seat opening therein, side walls extending up from the platform at opposite sides thereof, a back extending up from the platform, and a front section extending down from the platform.

* * * * *